US005785185A

United States Patent [19]

Klebba

[11] Patent Number: 5,785,185

[45] Date of Patent: Jul. 28, 1998

[54] ROTARY SHOE RACK

[76] Inventor: Clem M. Klebba, 1452 Welling, Troy, Mich. 48098

[21] Appl. No.: 845,090

[22] Filed: Apr. 21, 1997

[51] Int. Cl.[6] ..... A47F 7/00

[52] U.S. Cl. ..... 211/37; 211/163; 211/181.1

[58] Field of Search ..... 211/34, 35, 37, 211/163, 181.1, 95; 248/425

[56] References Cited

U.S. PATENT DOCUMENTS

| | | | |
|---|---|---|---|
| 2,845,182 | 7/1958 | Atkinson | 211/37 |
| 3,135,389 | 6/1964 | Farley | 211/37 |
| 4,036,367 | 7/1977 | Stambaugh et al. | 211/163 X |
| 4,915,238 | 4/1990 | Cassel | 211/37 |
| 5,076,442 | 12/1991 | Hakeem | 211/35 X |
| 5,103,985 | 4/1992 | Davis | 211/37 |
| 5,127,528 | 7/1992 | Cone | 211/37 X |
| 5,423,435 | 6/1995 | Pollard et al. | 211/37 |
| 5,636,751 | 6/1997 | Frank | 211/163 X |
| 5,704,497 | 1/1998 | Wyatt | 211/163 |

*Primary Examiner*—Robert W. Gibson, Jr.
*Attorney, Agent, or Firm*—Charles W. Chandler

[57] ABSTRACT

A rotary shoe rack can include an upright frame mounted on a circular base, and two sets of horizontal support members extending in opposite directions from the frame. Each support member mounts six upwardly projecting shoe supports. There are several horizontal support members in each set, such that the rack has a relatively large shoe capacity. The shoe supports are constructed and arranged so that each shoe on the rack is visible, even when the rack is fully loaded with shoes.

14 Claims, 2 Drawing Sheets

ROTARY SHOE RACK

BACKGROUND AND SUMMARY OF THE INVENTION

This invention relates to a rotary shoe rack, and particularly to a portable shoe rack having a relatively large shoe capacity, e.g. forty two pairs of shoes.

Various rotary shoe rack constructions have been suggested. However, none of the previously proposed constructions has the combination of features possessed by the shoe rack construction of the present invention. The shoe rack of this invention is designed to display two vertical rows of shoe supports facing in opposite directions above a rotary turntable. Each vertical row of shoe supports is adapted to contain a relatively large number of shoes, e.g. twenty one pair of shoes. The user can view a relatively large number of shoes without turning the shoe rack around the turntable axis; different shoes and shoe styles can be compared on the rack when selecting a shoe that is to be worn on a particular day or with a particular outfit.

The shoes are supported in inverted positions on the rack, with the soles of the shoes facing the rack interior space, and with the toe areas facing outwardly away from the rack interior space. The toe areas of the shoes are clearly visible to a user standing in front of the rack. The user has a good view of all of the displayed shoes for shoe selection purposes.

As noted above, the prior art shoe racks do not have the combined advantages of shoe racks embodying this invention, e.g. a large shoe capacity and good visibility of all of the displayed shoes.

U.S. Pat. No. 4,981,222 issued Jan. 1, 1991, to Michael J. Davis for "Footwear Rack" shows a footwear rack that includes a square support frame for sinuous wire members that define inverted U-shaped loops adapted to extend within the toe areas of shoes, whereby the shoes are suspended along the perimeter of the support frame.

U.S. Pat. No. 5,127,528 issued Jul. 7, 1992, to Margaret E. Cone for "Extendable Rotary Shoe Rack" shows a rotary shoe rack that includes a number of upwardly extending hooks for suspending shoes at a number of points around a central tubular post.

U.S. Pat. No. 5,050,746 issued Sep. 24, 1991, to Doris N. Frankel for "Rotary Shoe Rack" shows a rotary shoe rack that includes several circular shelves radiating from a vertical shaft. A ring encircles the shaft in the space above each shelf, whereby shoes can be supported on the shelves with heel areas of the shoes hooked over the associated rings.

U.S. Pat. No. 5,423,435 issued Jun. 13, 1995, to Rosalie M. Pollard and Clyde J. Beck for "Modular Rotating Shoe Rack" shows a rotating shoe rack that includes a central shaft and groups of radial arms extending outwardly from the shaft at vertically spaced locations. Each radial arm has two upwardly-extending shoe supports for supporting a pair of shoes in inverted positions.

U.S. Pat. No. 5,065,871 issued Nov. 19, 1991 to Huan-Yin Chan for "Multi-Deck Type of Rotary Shoe Rack" shows a rotary shoe rack that includes plural rotary collars spaced along a vertical support shaft. Each collar supports a number of shoe-support rods angling upwardly and outwardly away from the shaft axis.

U.S. Pat. No. 5,118,176 issued Jun. 2, 1992 to Raymond W. Motley, Sr. for "Shoe Support Apparatus" shows a rotary shoe rack that comprises a four sided housing mounted for rotation around a vertical axis. The shoes are supported on flat support plates radiating outwardly from the housing. Each plate is sloped away from the housing axis, whereby the shoes have their toe areas pointed downwardly away from the housing.

U.S. Pat. No. 5,033,626 issued Jul. 23, 1991 to Rita J. Platti for "Rotating Shoe Enclosure Rack" shows a rotary shoe rack that includes a central post for supporting a number of circular housings, one above the other. Each housing has plural pre-shaped compartments that open to the housing periphery for insertion of shoes into the compartments.

The present invention relates to a rotary shoe rack having practical advantages over the prior art shoe racks. One shoe rack embodying the invention comprises a rotary circular base having an upstanding inverted U-shaped frame located in a vertical plane extending across the rack rotational axis. Plural horizontal U-shaped support members extend from the upstanding frame at different levels, from the bottom of the frame to the top of the frame. Preferably, two sets of U-shaped support members extend in opposite directions from the frame. Each set of support members has a relatively large number of shoe supports mounted thereon. In one case, there are seven support members in each set; each support member supports six shoe supports. The total shoe capacity of this rack is forty two pairs of shoes.

Further features of the invention will be apparent from the drawings and description of a preferred embodiment of the invention.

DESCRIPTION OF THE DRAWINGS

The description refers to the accompanying drawings in which like reference characters refer to like parts, throughout the several views, and in which.

DESCRIPTION OF A PREFERRED EMBODIMENT OF THE INVENTION

Figure 1:
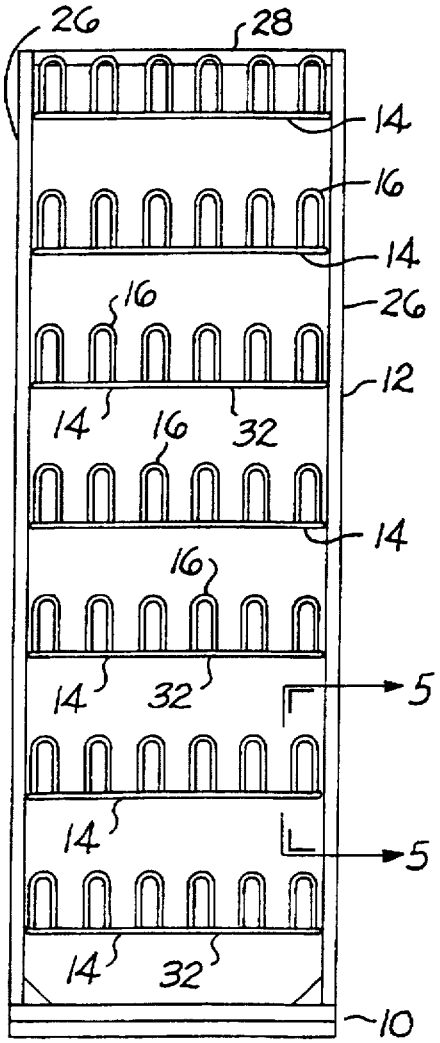
FIG. 1 is a front elevational view of a rotary shoe rack embodying the invention.

FIG. 1 shows a rotary shoe rack embodying the invention. The rack comprises a circular base 10, an upstanding fame 12 supported by the base, and two sets of horizontal U-shaped support members 14 extending from the frame in opposite directions. Each U-shaped support member 14 carries six shoe supports 16. The rack has a shoe capacity of forty two pairs of shoes.

Figure 4:
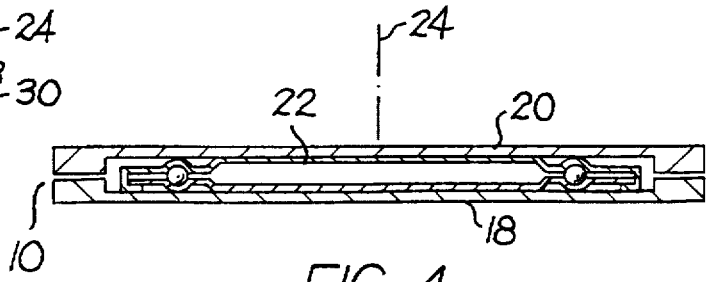
FIG. 4 is a sectional view taken through a base structure employed in the FIG. 1 shoe rack.

Circular base 10 can be constructed in various ways. As shown in FIG. 4, the base comprises a lower circular disk 18 seatable on the room floor and an upper rotary disk 20. An anti-friction turntable 22 is adhesively attached to disks 18 and 20, whereby disk 20 can be manually rotated around a central axis 24. As shown in FIG. 4, the turntable comprises two metal plates having confronting annular tracks and an array of anti-friction balls in the tracks, contributing to easy rotation of rotary disk 20.

Frame 12 comprises two uprights 26 suitably affixed to disk 20 and a cross piece 28 connected to the upper ends of the uprights. The frame can be formed of wood, steel or aluminum. The frame is located in an imaginary vertical plane 30 containing the rack rotational axis 24.

Figure 2:
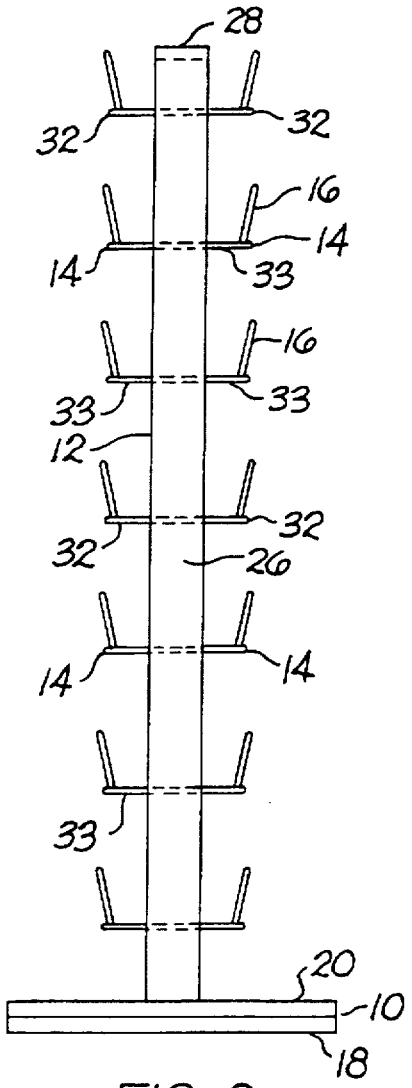
FIG. 2 is a side elevational view of the FIG. 1 shoe rack.

Each U-shaped support member 14 comprises a horizontal bar 32 and two arms 33 extending right angularly from the bar across the uprights 26. Each arm 33 is fixed to one of the uprights, whereby the associated bar 32 has a fixed orientation relative to the upright frame 12. Each bar 32 extends parallel to the frame plane 30. As shown in FIG. 2, two sets of support members 14 extend in opposite directions from the centrally-located frame 14. Each support member 14 is preferably formed out of round cross-sectioned metal rod stock. The rod can have a diameter of about one eighth inch.

As shown in FIG. 1, each horizontal bar (or rod) 32 supports six shoe supports 16. Each shoe support comprises a metal rod or heavy wire bent into a U-configuration. End areas of the rod (or heavy wire) are welded to bar 32 to provide an upwardly-projecting shoe support.

Figure 5:
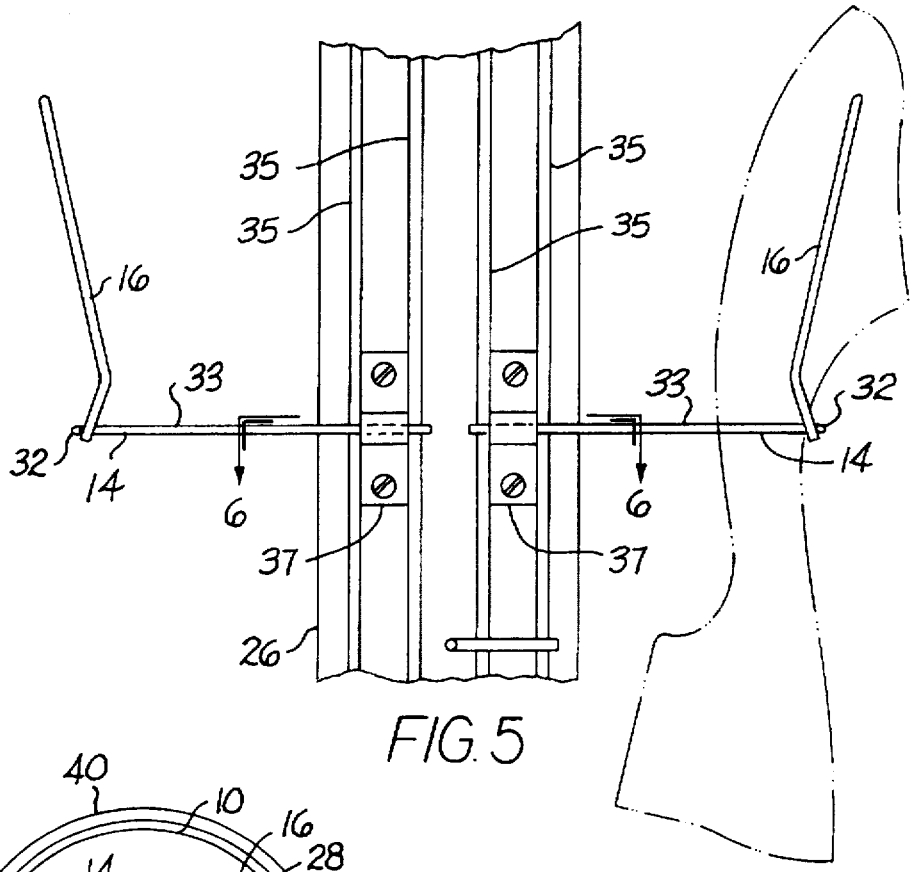
FIG. 5 is an enlarged fragmentary sectional view taken on line 5—5 in FIG. 1.

As shown in FIG. 5, each U-shaped rod element 16 is bent transverse to the plane of the U, so that the shoe support extends upwardly and outwardly away from the plane of frame 12. The shoe is inserted onto the upper curved end of the shoe support so that the sole area of the shoe faces frame 12, and the toe area of the shoe faces away from frame 12.

The upper surface of the toe area of the shoe is visible to a person standing in front of the rack, even when the rack is fully loaded with shoes. The heel area of the shoe is located within the space circumscribed by the U-shaped support member 14, so that the shoe can assume a tilted position facing away from the plane of frame 12. The tilted condition facilitates placement of shoes one above another on the different support members 14, with the toe area of a lower shoe partially overlapping the heel area of the shoe located above. As noted previously, the toe areas of all of the shoes are clearly visible, even when the rack is fully loaded with shoes.

Figure 3:
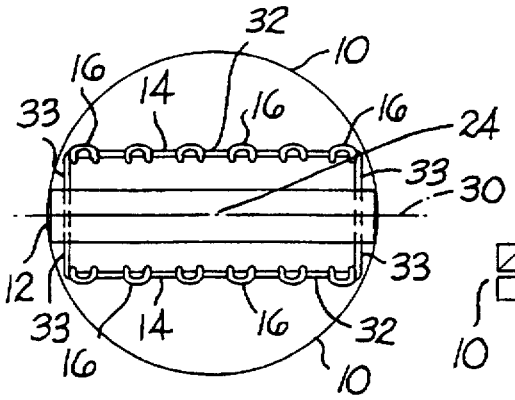
FIG. 3 is a top plan view of the FIG. 1 shoe rack.

As can be seen from FIG. 3, shoe supports 16 are located within the space directly above circular base 10, i.e. within an imaginary circular envelope defined by the circular base. This feature prevents the supported shoes from striking adjacent objects when the rack is rotated to gain access to the normally hidden set of shoe supports. For example, if the rack is located in a corner of a room or closet, the rack can be rotated without having any of the shoes strike against the room wall or closet wall. The rack is designed particularly for usage in a home or apartment. However, the rack can also be used as a shoe display device in a shoe sales store.

The various support members 14 and shoe supports 16 preferably have a common spacing, such that the rack space is fully utilized. Preferably support members 14 in each set are spaced the same vertical distance apart, with each support member being located directly above or below the neighboring support member. Also, the shoe supports 16 are preferably identically sized, with a common spacing between neighboring shoe supports. The aim is to provide a rack having a finished appearance, reflective of high quality manufacturing operations.

In order to attain the desired uniformity and tolerance control, the wire and rod members 14 and 16 in each set are manufactured and assembled together as a separate assembly apart from frame 12. Each separate assembly is mounted in frame 12 after the assembly is complete.

Each U-shaped support member 14 has the associated shoe supports 16 welded thereto prior to the step of connecting the support members together. The various support members 14 are interconnected by two tie rods 35 welded to each arm 33. FIG. 5 shows two vertical tie rods 35 welded to one arm 33 of an associated support member 14; two additional tie rods would be welded to the other arm 33 (not shown). The welded connections are repeated for each of the seven support members 14 in the set (left hand or right hand in FIG. 3).

Figure 9:
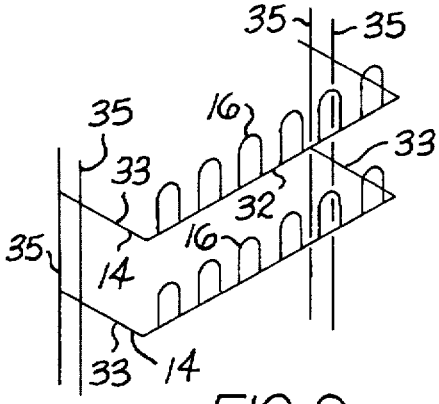
FIG. 9 schematically illustrates a rod sub-assembly usable in the FIG. 1 shoe rack.

FIG. 9 fragmentarily and schematically shows the welded sub-assembly that provides the desired tolerance control on positioning of support members 14 and shoe supports 16. Tie rods 35 tie the various support members 14 together, with the desired uniform spacing and vertical alignment. The process of welding the tie rods 35 to the support members 14 is performed in a fixture that provides the necessary tolerance control. Tie rods 35 are spaced apart, so that when the welded sub-assembly is placed within frame 12 the tie rods will be in near proximity to the facing surfaces of uprights 26.

The welded sub-assembly can be affixed to the frame with clamping brackets 37 (FIG. 5) clamped around selected ones of horizontal arms 33. As shown in FIG. 5, the brackets may be attached to uprights with screws.

Figure 7:
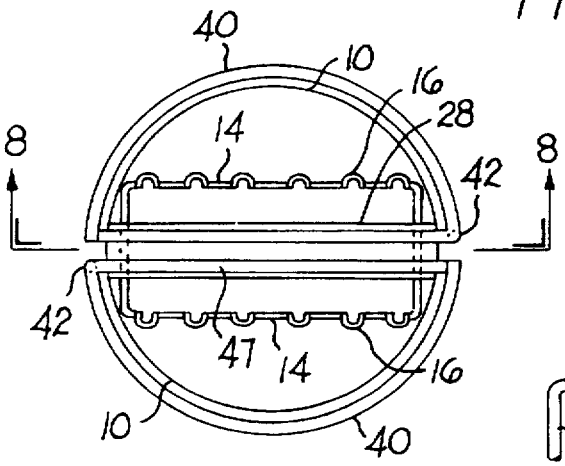
FIG. 7 is a top plan view of the FIG. 1 shoe rack equipped with two arcuate curtains adapted to enclose the rack interior space.
Figure 6:
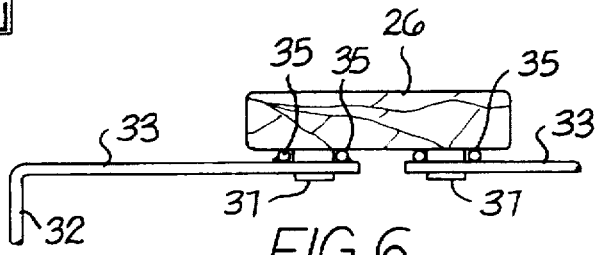
FIG. 6 is a fragmentary sectional view taken on line 6—6 in FIG. 5.
Figure 8:
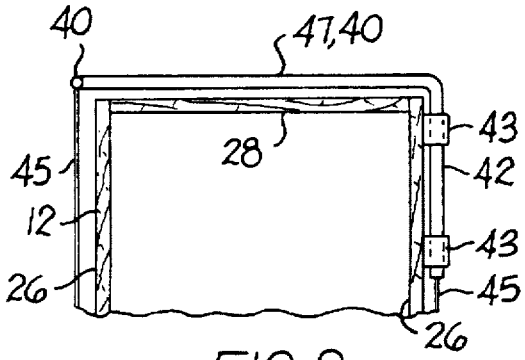
FIG. 8 is a fragmentary sectional view taken on line 8—8 in FIG. 7.

FIGS. 7 and 8 show an additional feature that can be used in practice of the invention. Two semi-circular curtain rods 40 extend around the circular envelope defined by circular base 10. Each curtain rod 40 has a downwardly-extending pivot shaft 42 swivel mounted in bearings 43 attached to an upright 26, whereby the curtain rod can be swung in a horizontal plane around the axis of pivot shaft 42.

A fabric curtain 45 is hung on each curtain rod 40 so as to normally encircle the spaces occupied by the shoe supports 16. Each curtain can be swung open to gain access to the shoe supports. As an optional feature, each curtain rod 40 can be reinforced against sagging by means of a reinforcement rod 47 spanning the ends of the curtain rod.

The drawings show a specific form of the invention. However, it will be appreciated that the invention can be practiced in various forms and configurations.

Having described my invention, I claim:

1. A rotary shoe rack comprising a circular base rotatable around a central vertical axis; an inverted U-shaped frame extending vertically upwardly from said base; said frame comprising two spaced uprights located in a plane containing the rack rotational axis; a first set of U-shaped support members extending horizontally from said uprights in a first direction normal to the plane of said uprights; a second set of U-shaped support members extending horizontally from said uprights in a second direction normal to the plane of said uprights;

each U-shaped support member comprising a horizontal bar extending parallel to the plane of said uprights; and plural shoe supports mounted on each horizontal bar.

2. The shoe rack of claim 1, wherein each shoe support comprises an inverted U-shaped wire element.

3. The shoe rack of claim 1, wherein each U-shaped support member comprises two arms extending right angularly from an associated horizontal bar across said uprights.

4. The shoe rack of claim 3, wherein each U-shaped support member is formed of metal rod stock.

5. The shoe rack of claim 1, and further comprising plural tie rods interconnecting the U-shaped support members in each said group; said tie rods and said U-shaped support members in each said group forming a rigid assembly separate from said uprights.

6. The shoe rack of claim 1, wherein each U-shaped support member comprises two arms extending right angularly from an associated horizontal bar; plural tie rods interconnecting the arms of the U-shaped support members in each set; said tie rods and said U-shaped support members in each set forming a rigid assembly separate from said uprights.

7. The shoe rack of claim 6, wherein each U-shaped support member is formed of metal rod stock.

8. The shoe rack of claim 6, wherein said tie rods are welded to the U-shaped support members.

9. The shoe rack of claim 8, and further comprising bracket means clamping the arms of said U-shaped support members to said uprights.

10. The shoe rack of claim 1, wherein each shoe support comprises an inverted U-shaped wire element; each U-shaped wire element extending upwardly and outwardly away from the plane of said uprights, whereby a shoe can assume a tilted position facing away from the plane of said uprights.

11. The shoe rack of claim 1, wherein said shoe supports are located within an imaginary circular envelope defined by the circular base.

12. The shoe rack of claim 11, and further comprising an openable circular curtain means encircling the space occupied by said shoe supports.

13. The shoe rack of claim 12, wherein said circular curtain means comprises two semi-circular curtain rods pivotably mounted on said uprights for horizontal swinging motion.

14. The shoe rack of claim 12, wherein said frame comprises a cross piece spanning said vertical uprights; said circular curtain means comprising two semi-circular curtain rods pivotably mounted on said uprights for horizontal swinging motion in a plane spaced slightly above said cross piece.

* * * * *